United States Patent [19]

Ingram

[11] Patent Number: 4,465,001

[45] Date of Patent: Aug. 14, 1984

[54] TUFTING MACHINE NEEDLE BAR SHIFTING APPARATUS

[75] Inventor: Gary L. Ingram, Ooletwah, Tenn.

[73] Assignee: Spencer Wright Industries, Inc., Chattanooga, Tenn.

[21] Appl. No.: 480,244

[22] Filed: Mar. 30, 1983

[51] Int. Cl.[3] ..... D05C 15/26

[52] U.S. Cl. ..... 112/79 A

[58] Field of Search ..... 66/79 R, 79 A

[56] References Cited

U.S. PATENT DOCUMENTS 3,964,407 6/1976 Ingram et al. ..... 112/79 R 4,392,440 7/1983 Ingram ..... 112/79 A

*Primary Examiner*—Ronald Feldbaum

*Attorney, Agent, or Firm*—Alan Ruderman

[57] ABSTRACT

A cam actuated shifting apparatus for drivingly shifting the needle bar of a tufting machine has a pair of spaced rods journally mounted in a frame. A plate cam having pattern information on the periphery thereof is mounted on a drive shaft in a plane substantially parallel to a plane passing through the axes of the rods. A pair of followers are adjustably mounted at opposed dispositions across the cam for driving the rods in accordance with the information on the periphery of the cam. The cam is fastened to the shaft by means of an adapter secured to the cam and keyed to the shaft. A radially split collet abuts the adapter and has a split clamping collar disposed thereabout. A single bolt compresses the collar about the collet to secure the cam axially on the shaft, and upon release of the bolt readily permits the cam to be moved axially.

20 Claims, 6 Drawing Figures

TUFTING MACHINE NEEDLE BAR SHIFTING APPARATUS

BACKGROUND OF THE INVENTION

This invention relates to tufting machines and more particularly to apparatus for shifting the needles transversely relatively to the backing material between the longitudinal rows of tufted pile formed by the machine.

The art of tufting incorporates a plurality of yarn carrying space needles extending transversely across the machine and reciprocated cyclically to penetrate and insert pile into a backing material fed longitudinally beneath the needles. During each penetration of the backing material a row of pile is produced transversely across the backing. Successive penetrations result in a longitudinal row of pile produced by each needle. This basic method of tufting limits the aesthetic appearance of tufted carpet so produced.

Consequently, methods have been devised which effect relative shifting between the needles and the backing material that provide patterning effects and that break up the noticable alignment of the longitudinal rows which detract from the appearance of the product. Such patterning means generally referred to as needle shifting or stitch placement drives generally are either driven by a rotating cam, a programmable fluid driven device, or a programmable indexing apparatus for drivingly engaging the needle bar to effect displacement thereof. Because the cam driven type is simple, inexpensive and reliable, it has been and remains the most popular drive system.

A drive rod connects the pattern cam drive system to a mounting plate for transversely driving the needle bar. Heretofore, as illustrated in my co-pending U.S. application Ser. No. 253,800 filed Apr. 13, 1981, and assigned to the same Assignee as the present invention, the drive rod was directly connected to a cam follower mounting rod journalled in bearing blocks and extending across and in front of the face of the pattern cam. With this construction, the mounting rod is driven by the followers as determined by the information on the periphery of the cam. However, one disadvantage of this system is that when a pattern change is desired, the follower mounting rod together with the follower must be removed to permit exchange of pattern cams. Consequently, the time required for making a pattern change is substantial.

Moreover, each time a change in cam was effected the needle bar would move slightly so that the relationship of the needles to the hooks and loopers was changed, thereby requiring additional time to effect a pattern change.

Recognizing the need for rapid change of the pattern cam, recent developments have devised various cam mounting systems permitting the cam to be readily replaced. No such developments, however, have been directed toward locking the needle bar during such cam changes to maintain the needle to hook relationship.

SUMMARY OF THE INVENTION

Consequently, it is a primary object of the present invention to provide a tufting machine having a cam driven needle bar shifting apparatus in which the cam may be rapidly replaced to change patterns and having means for locking the apparatus to prevent change in the relationship between the needles and hooks when a cam change is made.

It is another object of the present invention to provide a cam driven needle bar shifting apparatus for a tufting machine in which a pattern cam is mounted on a drive shaft in front of a pair of spaced rods journalled for lateral shifting and driven by cam followers adjustably secured to the rods, the cams being secured on the drive shaft by a clamping member which may be readily released to permit changing of the cam.

It is a further object of the present invention to provide a cam driven needle bar shifting apparatus for a tufting machine in which a pattern cam is mounted on a drive shaft in front of a pair of spaced rods journalled for lateral shifting and driven by cam followers adjustably secured to the rods, and means for clamping the rods against movement when changing the cam.

It is a still further object of the present invention to provide needle bar shifting apparatus for a tufting machine having a pattern cam for driving followers, the cam being mounted for unobstructed replacement thereof, the followers being mounted between a pair of spaced rods journalled for lateral shifting and adjustable laterally relatively to the cam and the rods for accommodating various size cams and followers, and means for clamping the rods when cam replacement is occurring.

Accordingly, the present invention provides a cam actuated shifting apparatus for drivingly shifting the needle bar of a tufting machine, the apparatus comprising a drive shaft journally extending through a frame and having a pattern cam fastened adjacent the end thereof by means of a quick release clamping collar, the periphery of the cam being in engagement with a pair of diametrically opposed followers each being adjustably fastened to a clamping bar and the clamping bar being secured to and spanning a pair of slide rods journalled on the frame intermediate the cam and the front. The slide rods are fastened to means which connect to the needle bar to shift or jog the needle bar laterally in accordance with the information on the periphery of the cam. Since the laterally moving elements are mounted behind the cam, the cam may be removed quickly when pattern changes are desired. The followers are journalled on a block that may be adjustably fastened to the respective clamping block for lateral adjustment, the adjustment means permitting rapid and minute adjustment of the followers relatively to the cam and for changing followers when a cam of a drastically different size is installed. A simple clamping member may lock the slide rods against lateral movement when cam changes or follower adjustment is made thereby preventing a change in the relationship between the needles and the hooks of the tufting machine. When a double or split needle bar is mounted on the tufting machine the apparatus may be fastened to each needle bar at opposite ends of the machine as conventionally known in the art.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
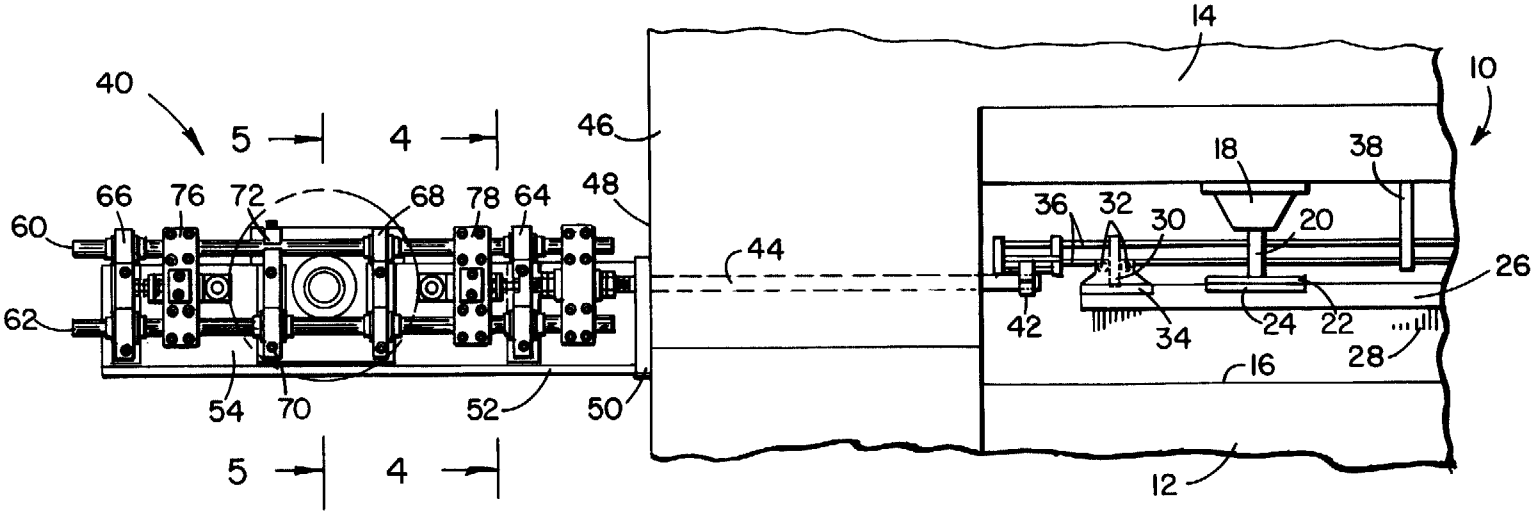
FIG. 1 is a fragmentary front elevational view of a tufting machine incorporating a needle bar shifting apparatus constructed in accordance with the principles of the present invention.

Referring now to the drawings, FIG. 1 generally illustrates a portion of a tufting machine 10 having a frame comprising a base 12 and a head 14 disposed above the base. The base 12 includes a needle plate 16 over which backing material (not illustrated) is adapted to be fed by conventional means.

Mounted in the head 14 for vertical reciprocation within one of a plurality of bushing assemblies 18 is a respective push rod 20 to the lower end of which a needle bar support foot 22 is carried. The support foot 22 has a slideway within which a slide plate 24 is slidably received. A needle bar 26 is secured to the plate 24 and slidable laterally relative to the slideway and reciprocably driven vertically by the action of the push rod. The needle bar 26 carries a plurality of needles 28 adapted to penetrate the base material upon reciprocation of the needle bar to project loops of yarn therethrough as the push rods are reciprocated by conventional means. The needles cooperate with loopers (not illustrated) mounted beneath the needle plate for seizing the loops of yarn presented by the needles and for releasing the loops to form loop pile or for holding the loops until cut by a knife cooperating with the loopers or hooks as is notoriously well known in the tufting art.

In order to drive the needle bar 26 selectively with controlled lateral movement, the needle bar 26 is provided with a number of upstanding plate members 30 which are straddled by a pair of rollers 32 pivotably mounted on mounting plates 34 secured to brackets (not illustrated) clamped to a pair of laterally extending slide rods 36. The slide rods are journalled in brackets 38 fixed to the head 14 of the machine above the needle bar. At the end of the machine adjacent the needle bar shifting apparatus, generally illustrated at 40, the slide rods 36 are fastened to a clamping block 42 above the bed. A drive rod 44 is secured to the clamping block 42 and extends through the end housing 46 of the tufting machine head 14 toward the shifting apparatus 40 and journalled in the end wall 48 for lateral movement.

Figure 2:
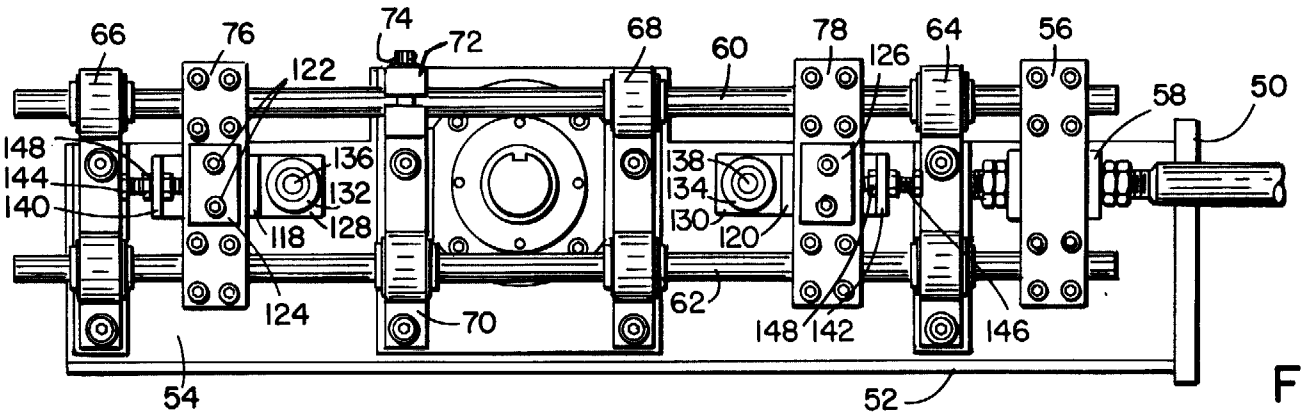
FIG. 2 is an enlarged view of the shifting apparatus illustrated in FIG. 1.
Figure 4:
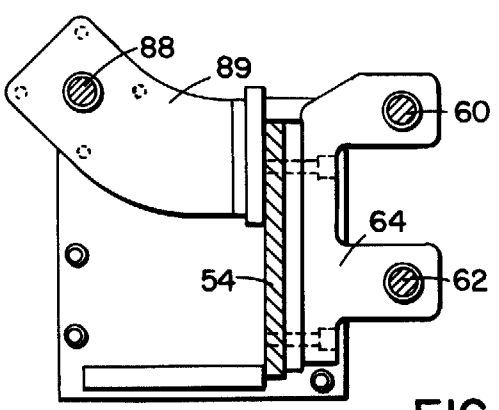
FIG. 4 is an enlarged cross-sectional view taken substantially along line 4—4 of FIG. 1.
Figure 6:
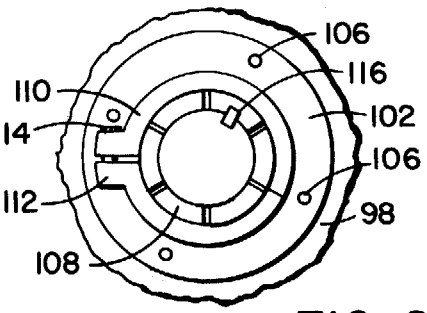
FIG. 6 is a fragmentary front elevational view illustrating the pattern cam securing means, as viewed along line 6—6 of FIG. 5.

The shifting apparatus 40, as best illustrated in FIG. 2, is mounted on a frame comprising an end plate 50 secured to the end wall 48, a bottom plate member 52 and a vertically upstanding plate member 54 laterally extending relative to the tufting machine and secured to the plates 50 and 52. The drive rod 44 journally extends through the end plate 50 and is fastened to a two piece clamping block 56 by collar means 58 entrapped between the elements of the clamping block 56 and to which the rod 44 is threadily fastened. Also clamped between the elements of the clamping block 56 in vertically spaced relationship are a pair of slide rods 60 and 62 similar to the rods 36. The rods 60, 62 extend laterally and are journalled within bearings in laterally spaced bearing blocks 64, 66, 68 the block 68 being intermediate the blocks 64 and 66. Another bearing block 70 intermediate blocks 66 and 68 has one bearing which, as illustrated, journally supports the slide rod 72, and which has a rod receiving arcuate upper end for receiving a circumferential portion of the other slide rod 60. Each of the bearing blocks 64–70 is secured by conventional means to the vertical plate member 54 so that the slide rods 60, 62 may accurately slide relatively to a rigid frame, the sliding being effected by means hereinafter described.

At the upper end of the bracket 70, a clamping member 72 is disposed having an arcuate cut-out conforming to that of the slide rod 60 for receiving the remainder of the circumference of the slide rod 60, i.e., the portion not received within the top of the block 70. The clamping member 72 is tapped so as to threadily receive two bolts or the like 74 (only one of which is illustrated) which normally are disposed so that the member 72 is above the top of the bearing blocks 70 to permit the rod 60 to slide. However, when a cam change is desired to be made as hereinafter described, the bolts 74 are threaded further into the top of the bearing block 70 and the member 72 is forced into engagment with the rod 60 and the top of the block 70 to lock the slide rod 60 thereto. Because the rods 60 and 62 are tied together by clamping block 56, and by two additional clamping blocks 76 and 78, locking of the rod 60 also locks the rod 62 against lateral movement. Consequently, when a cam change is being made the needle bar 26 is locked and its relationship to the loopers or hooks remains unchanged. This ensures that when the tufting machine is again operated the needles and loopers or hooks cooperate properly and repositioning of the needle bar 26 is not necessary.

Figure 5:
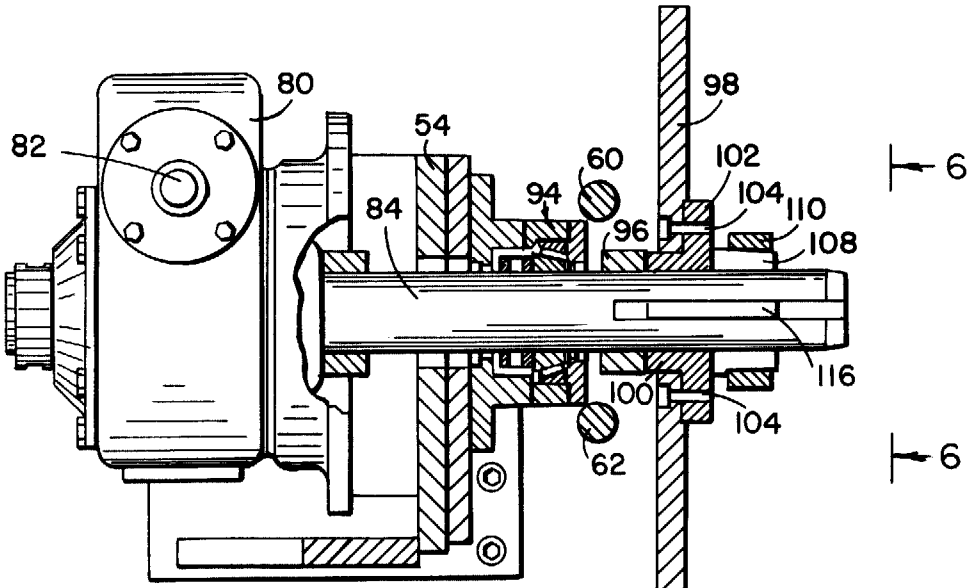
FIG. 5 is an enlarged cross-sectional view taken substantially along line 5—5 of FIG. 1 illustrating the pattern cam mounting construction.
Figure 3:
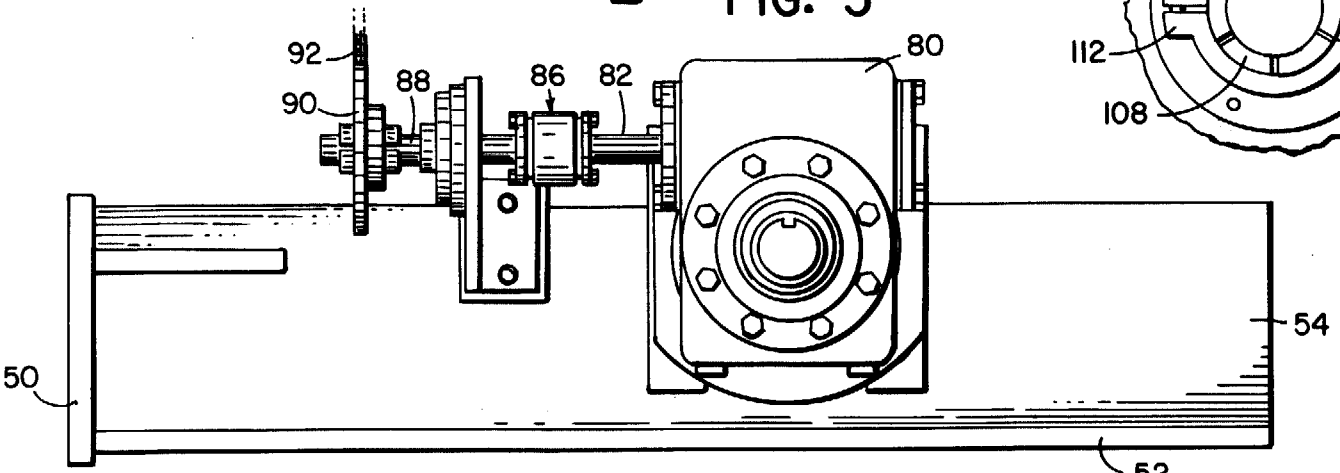
FIG. 3 is a rear elevational view of a portion of the shifting apparatus.

As best illustrated in FIG. 5, mounted intermediate the bearing blocks 68 and 70 on the plate 54 but on the reverse side of that from which the bearing blocks 64–70 extend, is a speed reducer 80 having an input shaft 82 and as illustrated in FIG. 5, an output shaft 84. The input shaft 82 is coupled through means 86 to a shaft 88 journalled in at least one bracket 89 and on which a drive sprocket 90 or the like is fastened. Input motion is imparted in timed relationship with the vertical reciprocation of the needle bar by means of a chain or the like 92 which is connected to a similar sprocket (not illustrated) mounted on the main shaft (also not illustrated) of the tufting machine, as is well known in the art. The output shaft 84 of the reducer 80 extends through and is journalled in bearing means 94 supported on the plate 54. The shaft projects intermediate and forwardly of the slide rods 60, 62 and has a collar 96 keyed thereto. An interchangeable pattern cam 98 is disposed in front of the collar 96 in a plane intermediate a plane passing through the rods 60, 62 and the free end of the slot 84. The cam 98 includes a bore for receiving the exterior of an axially extending hub 100 of an adapter plate 102 which abuts the collar 96. The face of the plate 102 adjacent the hub 100 is positioned in abutting relationship with the cam 98 and keyed to the shaft 84. Each of the cam 98 and the adapter 102 have cooperating holes such as illustrated at 104 for receiving bolts 106 which secure the cam 98 to the adapter 102 and thus to the shaft.

Disposed in abutment with the free surface of the plate 102 is a split collet 108 which is also keyed to the shaft 84. Preferably the adapter 102 and the collet 108 may be a single member. Positioned about the circumference of the split collet 108 is a split clamping collar 110 having a pair of offset legs 112 which are tapped to receive a clamping bolt 114 which when tightly threaded into the legs 112 secures the collet 108, adapter blade 102 and cam 98 against axial movement relative to the shaft 84. A single key 116 may secure these members to the shaft 84 against relative rotational movement, and thus when the single clamping bolt 114 is released, the cam 98 together with its adapter 102, the collet 108 and the clamping collar 110 may be readily removed and replaced with a new cam.

Each of the clamping blocks 76, 78 is a two piece member like the block 56 having two members clamped together about the rods 60, 62. However, the blocks 76, 78 also have a respective follower carrier 118, 120 clamped between the members and secured thereto by bolts 122 acting against respective bearing plates 124, 126. At the end of the respective carrier 118, 120 adjacent the follower, the carriers have a respective block 128, 130 on which are mounted respective bearing members 132, 134 which journally carry respective followers 136, 138, the followers 136 acting against the periphery of the cam 98 at substantially diametrically opposed locations. At the other end of each carrier 118, 120 a respective flange 140, 142 extends from the surface of the carriers 118, 120 and receives respective bolts 144, 146. The bolts 144, 146 each extend through the respective flange and at one end abut the adjacent end of the respective clamping block 76, 78. Stop nuts 148 threaded on the bolts 144, 146 straddle the respective flange 140, 142 and secure the roller carrier against lateral movement relative to the followers.

To accurately adjust the rollers 136, 138 against the follower 98, the bolts 122 are loosened to release the respective plates 124, 126 and the respective front half of the clamping blocks 76, 78 from the respective carrier 118, 120. The adjusting stop nuts 148 are thereafter loosened so that the carrier may be moved laterally until the respective follower engages the periphery of the cam. Consequently, when a cam change is made, the followers can be accurately positioned against the periphery of the new cam. Similarly, smaller or larger followers may be readily installed when a different size pattern cam is installed on the apparatus.

During operation of the shifting apparatus, as the cam 98 rotates it drives the followers 136, 138 in accordance with the information on its periphery. As the followers move laterally, they drive the blocks 76, 78 to which they are fastened, which in turn drives the rods 60, 62 and thus the needle bar 26 through the drive rod 44.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. In combination with a tufting machine having a needle bar reciprocable vertically relative to a base material fed through said machine and mounted for lateral movement relative to the base material, and drive means connected to said needle bar for shifting the needle bar laterally, apparatus for laterally moving said drive means in accordance with a pattern, said apparatus comprising, a plate cam having pattern information on a peripheral surface thereof, means including a shaft for rotating said cam in timed relationship with the reciprocation of said needle bar, a pair of spaced rods, means for journally mounting said rods for slidable movement laterally, said shaft being disposed intermediate said rods and extending substantially normal to a plane passing through said rods and terminating at a free end spaced from said plane, said cam being disposed in a second plane intermediate the rods and said free end, locking means intermediate said free end and said cam for drivingly connecting said cam to said shaft, whereby said cam may be removed axially from said shaft upon release of said locking means, a pair of followers, follower mounting means for mounting said followers in engagement with said peripheral surface of said cam at substantially diametrically opposed dispositions across said cam, means for fastening said follower mounting means to both of said rods for driving said rods laterally as determined by said cam, and means for connecting said rods to said drive means.

2. In the combination as recited in claim 1, including means for selectively locking said rods against movement, whereby said rods and thus said needle bar may be secured against lateral movement when said cam is being changed.

3. In the combination as recited in claim 1, wherein said means for journally mounting said rods comprises a rigid frame, and a plurality of bearing blocks secured to said frame, at least one of said bearing blocks having an open recess for receiving one of said rods, and clamping means for selectively locking said one rod in said recess to said one bearing block to preclude lateral movement of said rods and said needle bar when said cam is being changed.

4. In the combination as recited in claim 1, wherein said locking means includes an adapter removeably keyed to said shaft for rotation therewith, means for fastening said adapter to said cam, and fastening means for locking said adapter to said shaft for precluding relative axial movement therebetween.

5. In the combination as recited in claim 4, wherein said fastening means includes a collet split radially into segmental portions fast on said shaft in abutment with said adapter, and a split collar disposed about said collet, said collar having a pair of legs adapted to be secured together for compressing said segments of said collet toward said shaft, and means for securing said legs together.

6. In the combination as recited in claim 1, wherein said follower mounting means comprises a follower carrier for each follower, means for journally mounting each follower on a respective carrier, and means for adjustably securing each carrier to said means for fastening said follower means to both said rods.

7. In the combination as recited in claim 1, wherein said means for mounting said follower mounting means to both said rods comprises a block for each follower, each block comprising first and second members having means adapted to receive each of said rods securely therebetween, and means for clamping the corresponding first and second members together to securely entrap said rods between said first and second members.

8. In the combination as recited in claim 7, wherein said follower mounting means comprises a follower carrier for each follower, means for journally mounting each follower on a respective carrier, and adjustable means for adjustably securing each carrier to a respective block for lateral movement of each carrier.

9. In the combination as recited in claim 7, wherein each carrier is clamped intermediate the first and second members of the respective block, and said adjustable means includes a stop member acting laterally between each carrier and the respective block, and means for adjusting each stop member to change the lateral disposition between the carrier and the block.

10. In the combination as recited in claim 2, wherein said means for mounting said follower mounting means to both said rods comprises a block for each follower, each block comprising first and second members having means adapted to receive each of said rods securely therebetween, and means for clamping the corresponding first and second members together to securely entrap said rods between said first and second member.

11. In the combination as recited in claim 10, wherein said follower mounting means comprises a follower carrier for each follower, means for journally mounting each follower on a respective carrier, and adjustable means for adjustably securing each carrier to a respective block for lateral movement of each carrier.

12. In the combination as recited in claim 11, wherein each carrier is clamped intermediate the first and second members of the respective block, and said adjustable means includes a stop member acting laterally between each carrier and the respective block, and means for adjusting each stop member to change the lateral disposition between the carrier and the block.

13. In the combination as recited in claim 3, wherein said means for mounting said follower mounting means to both said rods comprises a block for each follower, each block comprising first and second members having means adapted to receive each of said rods securely therebetween, and means for clamping the corresponding first and second members together to securely entrap said rods between said first and second member.

14. In the combination as recited in claim 13, wherein said follower mounting means comprises a follower carrier for each follower, means for journally mounting each follower on a respective carrier, and adjustable means for adjustably securing each carrier to a respective block for lateral movement of each carrier.

15. In the combination as recited in claim 14, wherein each carrier is clamped intermediate the first and second members of the respective block, and said adjustable means includes a stop member acting laterally between each carrier and the respective block, and means for adjusting each stop member to change the lateral disposition between the carrier and the block.

16. A cam actuated shifting apparatus for a tufting machine having a vertically reciprocal needle bar mounted for lateral movement relatively to a base material fed through the machine, said apparatus comprising a frame, a pair of spaced rods, bracket means secured to said frame having bearing means for journally supporting said rods for lateral sliding movement, a shaft journalled in said frame intermediate said rods and extending substantially normal to a plane passing through both said rods, means for rotating one end of said shaft in timed relationship with the reciprocation of said needle bar, the other end of said shaft extending beyond said plane for receiving said cam, said cam being a plate cam having pattern information on a peripheral surface thereof, means for fastening said cam on said shaft intermediate said plane and said other end of said shaft, follower means, means for adjustably fastening said follower means to both said rods for engaging said peripheral surface and for driving said rods in accordance with the information on said surface, and means for connecting said rods to said needle bar, said means for fastening said cam on said shaft including an adapter fastened to said cam, and clamping means for readily removing said adapter together with said cam from said shaft.

17. Shifting apparatus as recited in claim 16, including means on said bracket means for selectively clamping at least one of said rods against lateral movement to preclude movement of said needle bar while said cam is being changed.

18. Shifting apparatus as recited in claim 17, wherein said follower means comprises a pair of followers at substantially diametrically opposed dispositions across said cam, said means for adjustably fastening said follower means comprising a follower carrier for each follower, means for journally mounting each follower on a respective carrier, a mounting block for each follower, each block comprising first and second members adapted to clamp each of said rods and a respective carrier therebetween, and adjustable means for adjustably securing each carrier to a respective block.

19. Shifting apparatus as recited in claim 18, wherein said adjustable means includes stop means acting laterally between each carrier and the respective block, and means for adjusting each stop means to change the lateral disposition between the carrier and the respective block.

20. Shifting apparatus as recited in claim 19, wherein said clamping means includes a collet having a plurality of radial segments fast on said shaft in abutment with said adapter and a split collar disposed about said collet, said collar having a pair of legs extending radially from said shaft and adapted to be secured together for compressing said segments of said collet toward said shaft, and means for securing said legs together.

* * * * *